United States Patent [19]

Rommel

[11] 4,109,504

[45] Aug. 29, 1978

[54] CRIMPING TOOL FOR PRODUCING SOLDERLESS PERMANENT ELECTRICAL CONNECTIONS

[76] Inventor: Reiner Rommel, Moldaustrasse 6, 3570 Stadt Allendorf, Fed. Rep. of Germany

[21] Appl. No.: 789,878

[22] Filed: Apr. 22, 1977

[51] Int. Cl.[2] ..... B21D 7/06

[52] U.S. Cl. ..... 72/407; 72/416; 72/452; 72/453.03; 72/453.16

[58] Field of Search ..... 72/407, 412, 416, 450, 72/451, 453.03, 452, 453.16

[56] References Cited

U.S. PATENT DOCUMENTS

| | | | |
|---|---|---|---|
| 2,011,877 | 8/1935 | Shaff | 72/407 |
| 2,396,562 | 3/1946 | Forss | 72/407 |
| 3,037,208 | 6/1962 | Haberstump | 72/407 |
| 3,323,346 | 6/1967 | Spangler | 72/407 |
| 3,492,854 | 2/1970 | Eppler | 72/412 |
| 3,772,907 | 11/1973 | Rider | 72/452 |
| 3,834,215 | 9/1974 | Lemley | 72/410 |
| 3,972,218 | 8/1976 | Pawloski | 72/407 |

*Primary Examiner*—C.W. Lanham

*Assistant Examiner*—Gene P. Crosby

*Attorney, Agent, or Firm*—Max Fogiel

[57] ABSTRACT

A crimping tool with cheek plates that are closed and opened by an axially reciprocating piston via a lever drive. A securing arrangement operates as a function of the piston motion and permits an interruption of the piston drive, only after complete closure of the cheek plates. A pressure medium drive is controlled by a valve with an actuating lever for the piston. The securing arrangement operates jointly with the actuating lever or the pressure medium valve so that the pressure medium supply is interrupted only after complete closure of the cheek plates. A guide is provided at the actuating lever for turning on and off the cheek plate drive, and it extends in the direction of the piston movement. An abutment slides along it and is located on the piston. On one end of the guide, there is a point of engagement, and on the other end, at a distance corresponding to the full piston stroke, a point of disconnection is provided so that during actuation of the actuating lever, the guide and abutment are engaged, thereby holding the actuating lever in the turned-on position for the duration of a full piston stroke.

18 Claims, 7 Drawing Figures

CRIMPING TOOL FOR PRODUCING SOLDERLESS PERMANENT ELECTRICAL CONNECTIONS

BACKGROUND OF THE INVENTION

The present invention relates to a crimping tool for producing solderless electrical connections by pressed joining of the cables, lines or strands with the required connectors such as plugs, terminals, sockets, etc. Such tools usually have cheek plates which are opened and closed by an axially reciprocating piston via an intermediate lever drive. Depending on the design of the tool, the cheek may perform a spreading or closing motion in the form of a pair of pliers or there is a linear cheek movement. The lever drive located between the expanding cone on the piston and the cheeks makes possible the high pressures necessary for orderly press forming. The piston can be driven in various ways as, for example, by compressed air, whose entry into the cylinder of the piston is controlled by means of a valve moved by an actuating lever.

All known crimping tools, regardless of the drive, have the defect that the drive of the piston may be interrupted before it may perform a full power stroke. This leads to an inadequate defective pressing of the workpieces whose connection no longer meets the applicable safety and quality specifications. Another disadvantage is the expensive design where complex cast and press-formed parts are used, requiring extensive processing. Above all, they require a relatively large and heavy housing which must be capable of absorbing the high pressures and stresses incidental to crimping. Accordingly, such tools are very expensive, have a great weight and are hard to handle.

It is the object of the present invention to overcome these defects and to provide an uncomplicated, economically produced and tool with ease of handling, which can be easily disassembled in case of required repair, and which, independent of its operation, once the piston drive has been turned on, performs a complete pressing and ensures a perfect connection between cable and connector.

Another object of the present invention is to provide a crimping tool of the foregoing character which is substantially simple in construction and may be economically fabricated.

A further object of the present invention is to provide a crimping tool as described, which has a substantially long operating life.

SUMMARY OF THE INVENTION

The objects of the present invention are achieved by providing a safety arrangement operating as a function of the piston movement, which permits interruption of the piston drive only after completely closing the cheek plates. The simplified design is assured by providing a guide bearing for the piston rod; on the one hand; a linkage made up of forward extending draw rods and on the other hand a cylinder enclosing the piston are provided; the draw rods at their forward end form a holder for the interchangeable insertion of a tool head. On the rear end, the draw rods are inserted in a ring-shaped cage which is placed on the guide bearing of the piston rod and is secured by keys, etc.; the cylinder is slid onto the cage and held by a snap ring absorbing the tensile and compressive forces. On the other side, the cage is made up of two punched annular disks which are connected via spacer bolts.

When using a pressure medium drive (hydraulic or pneumatic), controlled by a valve with actuating lever, for the piston, the safety arrangement operates jointly with the actuating lever or the pressure medium valve in such a way that the pressure medium supply may be interrupted only after complete closure of the cheek plates.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompany drawings.

DESCRIPTION OF THE PREFERRED EMBODIMENT

Figure 1:
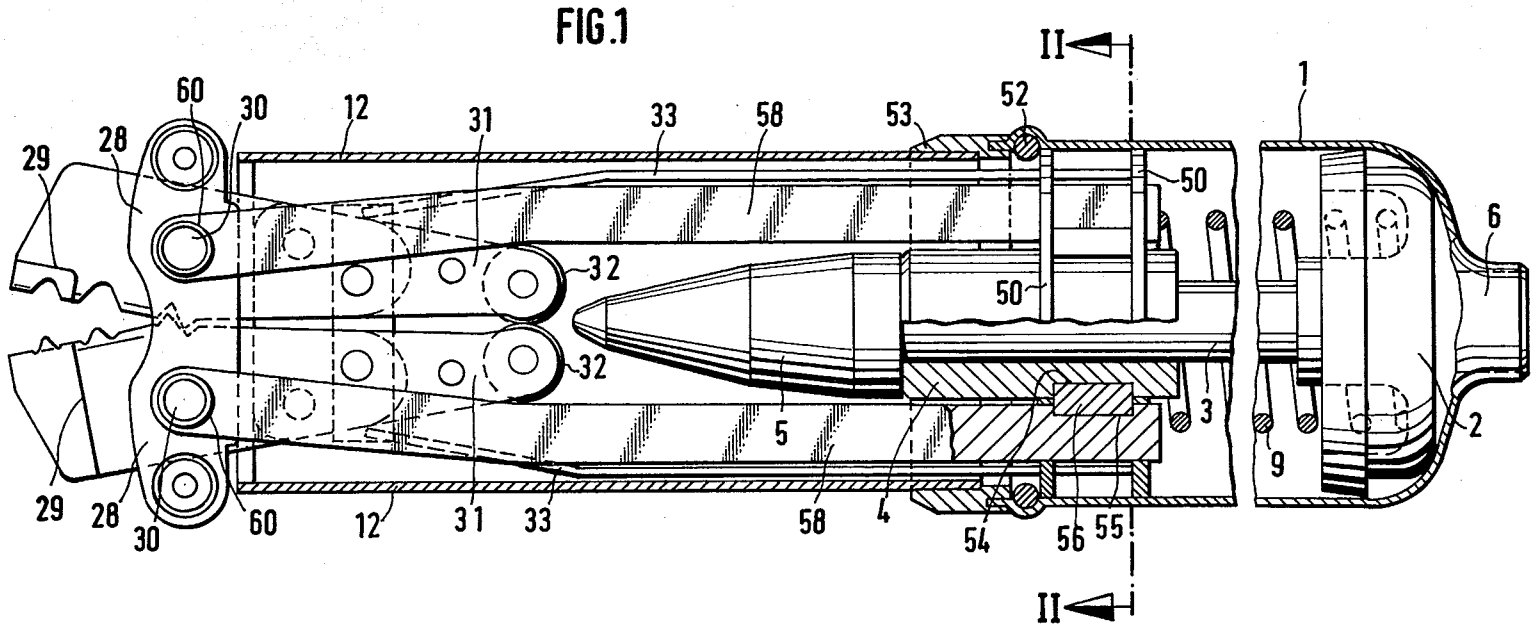
FIG. 1 shows a lengthwise section through a compressed-air operated crimping tool with cheek plates performing a spreading operation.

The rear portion of the tool is comprised of a compressed-air cylinder 1 in which there moves a piston 2; it is guided with its piston rod 3 in a guide bearing 4 and has an expander (spreading) cone 5 at the forward end of the piston rod.

At the rear end of cylinder 1, the cylinder cover has a connection 6 for attaching the valve housing 7 with the compressed-air connection 8. Between the guide bearing 4 and the piston 2 there is a compression spring 9 surrounding the piston rod 3 which takes care that the piston upon disconnection of the compressed air or when venting the cylinder 1 returns to its rear end position.

The guide bearing 4 supports a structure to be described later; this structure is enclosed by a housing jacket 12 and contains on its inside the lever arrangement for actuating the tool head which will also be explained later.

The connection and disconnection of the tool is made by means of a function bail blade 11 located on a shaft 10 on cylinder cap 13. By means of this actuating lever 11, an intake and outlet valve located inside the cap 13 or in the compressed-air connection 8 is actuated; this valve admits compressed air into the cylinder or vents the cylinder. The venting is done via a sound absorber insert 14.

The actuating lever 11 extends forward towards the tool head and is offset inwardly at its approximate center; it passes through a perforation 15 in the housing jacket 12. Inside the housing 12, the function bail balde 11 is followed by a guide 16, running in the direction of piston motion, with a guide slot 17. On its ends the slot 17 has expansions 18 and 19 which form a point of contact or disconnection for an abutment located on the expanding piston 5. This abutment on the expanding piston 5 is formed by a pin 20 which has a diameter corresponding to the slot width and has a head 21. At the transition from the slot 17 to the point of contact 18 or the disconnection point 19, there are chamfered sections 22 and 23; these work jointly with guide surfaces 24 and 25 on head 21 of the abutment and assist a frictionless sliding entry of the abutment into the slot guide 17, or its exit. In addition, the function bail blade 11 or guide 16 is guided by the trunnion 26 provided on the structure; compression springs 27 are provided which force guide 16 with the actuating lever 11 into the non-operating position. The tool is turned on by pressing the actuating lever 11 against the action of springs 27. If the compressed air supply is to be cut off or the cylinder is to be vented, it suffices to release the actuating lever 11. In order to prevent and unintentional shutoff of the tool when the crimping process has not yet been completed, i.e., when the operating piston has not yet reached its end position, the safety catch formed by guide 16 and the abutment 20, 21 is provided.

When the actuating lever is pressed down, the abutment 20 with head 21 goes through the entry point 18 of guide 17 so that the head 21 is now above guide 16. Since the compressed-air supply is turned on upon depressing the actuating lever 11, the piston 2 with the expanding piston 5 immediately starts its power stroke towards the tool head. The abutment 20 enters the guide slot 17 with the head 21 contacting the topside of guide 16, i.e. the return of the actuating lever 11 is prevented. Since the guide slot 17 in the guide 16 corresponds to the full length of the piston stroke, the abutment 20, 21 with the expanding piston 5 slides into the zone of disconnection point 19. Having arrived there, the expanding cone 5 has pressed the cheek plates together to their final position. Thus the crimping process is completed so that the tool can open again as soon as the function bail blade 11 is released by the operator. At this instant the springs 27 act to disengage the guide 16 from the abutment 20, 21.

Figure 6:
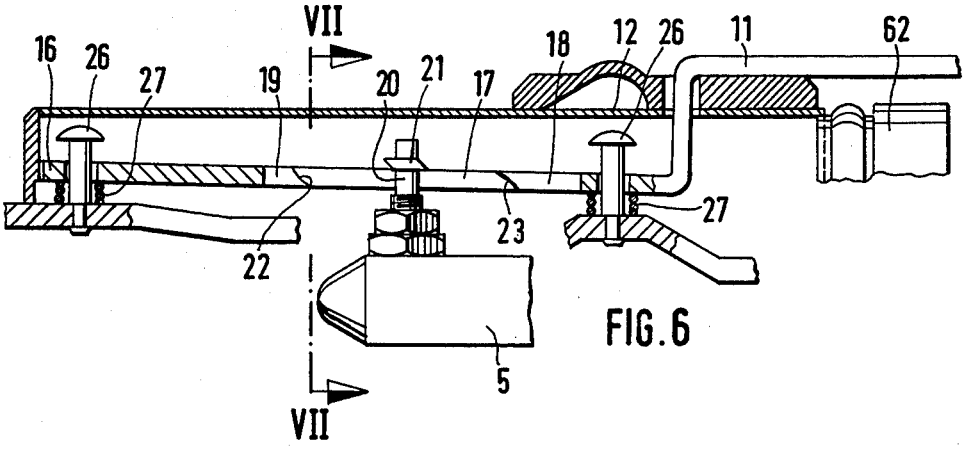
FIG. 6 shows a section through the forward section of the actuation lever in the engaged position.
Figure 7:
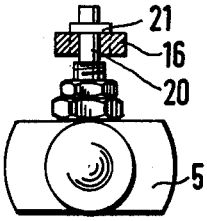
FIG. 7 shows a detail of the device, a section taken along line VII—VII in FIG. 6.

FIG. 6 shows the position of the individual parts during the power stroke of the piston.

Figure 3:
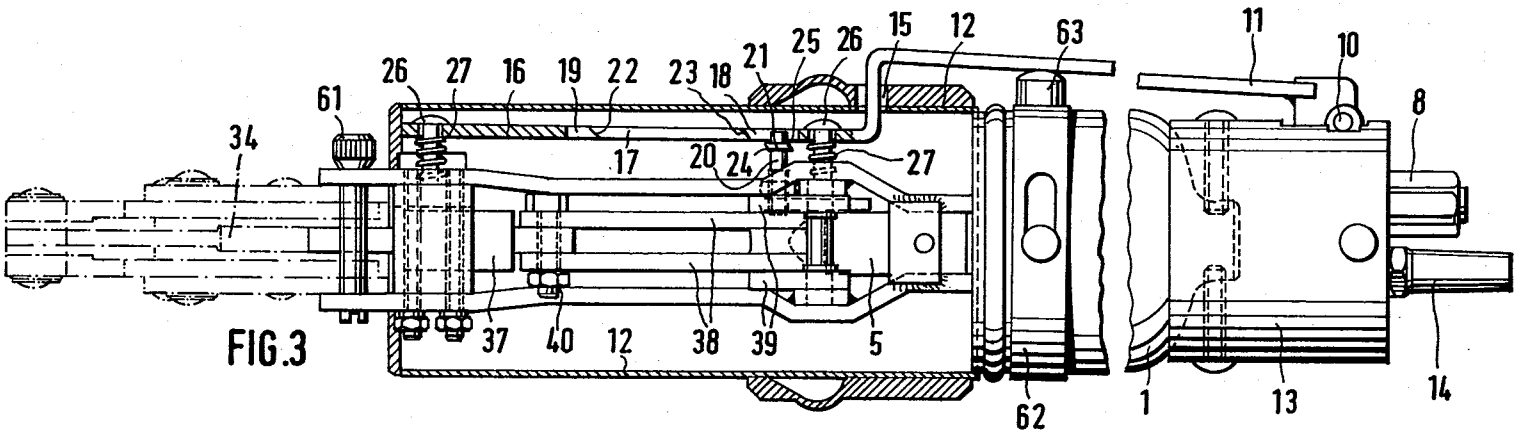
FIG. 3 shows a side view of another embodiment of a crimping tool with linear cheek plate motion, with a partial section.
Figure 4:
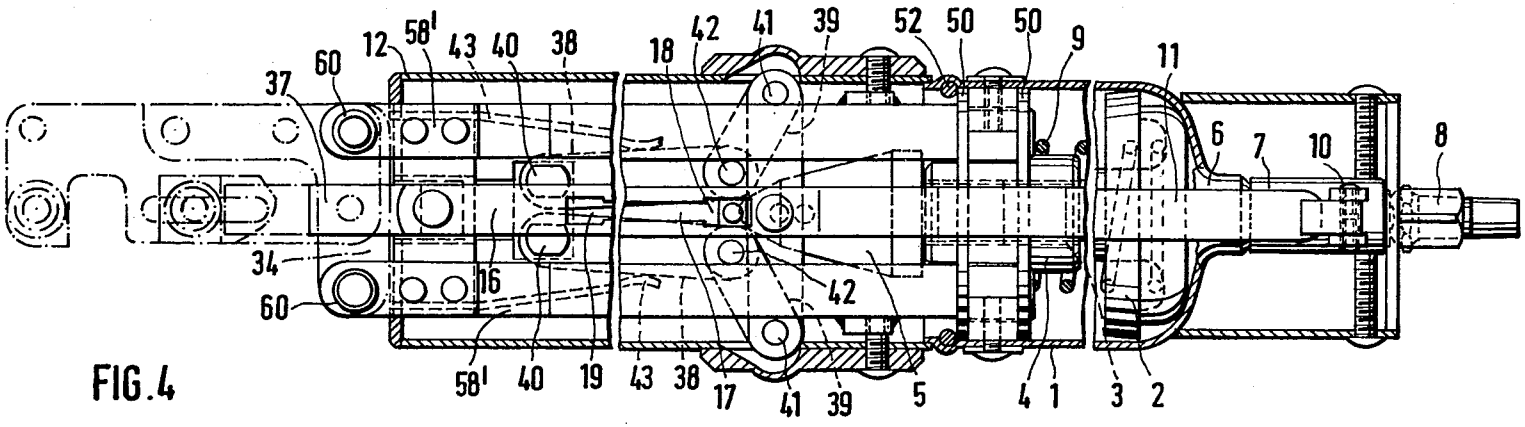
FIG. 4 shows a lengthwise section through the device of FIG. 3 in a view rotated by 90°.
Figure 5:
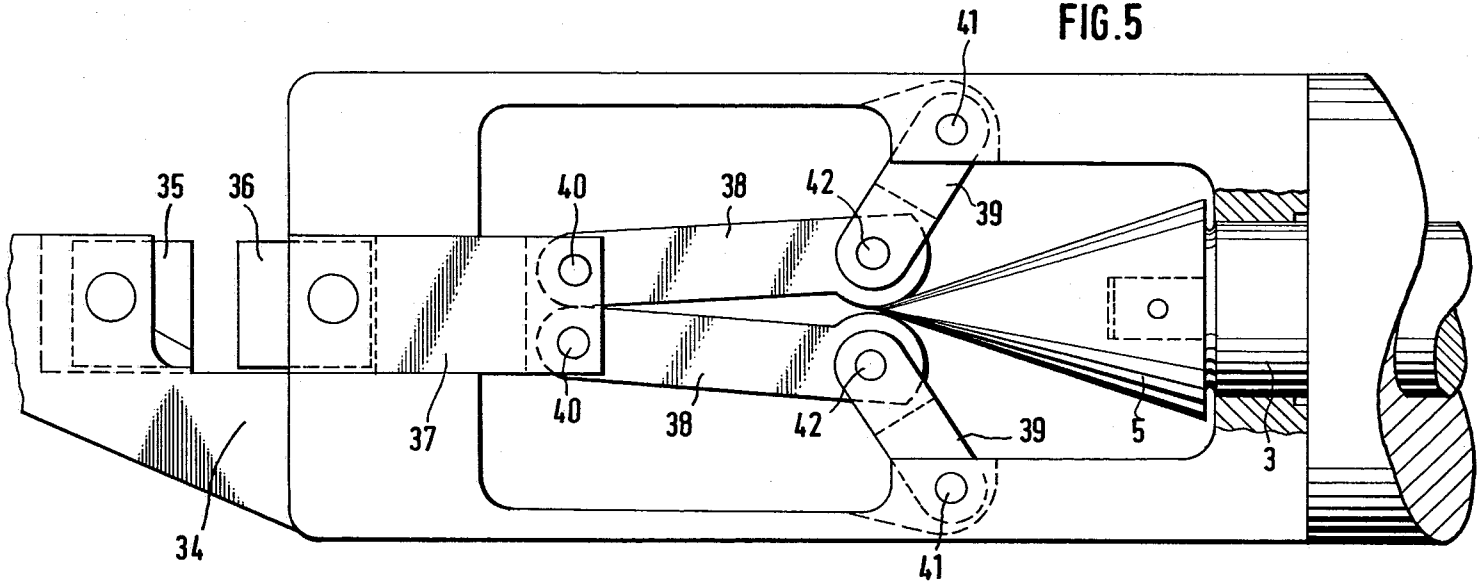
FIG. 5 shows a schematic to explain the cheek plate drive.

The safety device just described can be used both with spreading press tools as shown in FIG. 1 or with those with linear opening and closing motion of FIGS. 3 and 4 or 5.

The embodiment of the tool of FIG. 1 uses a tool head 28 with opening and closing cheek plates 29 which are mounted on trunnions 30 in the tool head 28 and have on their inwardly extending legs 31 the runner rollers 32 which work jointly with the expanding cone 5. By leaf springs 33 on both sides, the legs 31 of cheek plates 29 are pressed inward or the cheek plates are opened.

During the power stroke of the piston, it presses the expanding cone 5 between the rollers 32 so that the two legs 31 are pressed apart and the cheek plates 29 are pivoted inward about the trunnions 30 to their closed position.

The schematic of FIG. 5 shows a crimping tool whose cheek plates open and close linearly. Here the tool head 34 has a fixed cheek plate 35 and an axially movable cheek plate 36 which is located in a slide 37 that slides in the framework of the device. On trunnion 40 on slide 37, bell crank 38 is mounted, on trunnion 41 in the framework of the tool bell crank 39 is mounted. Cranks 38 and 39 are connected by hinge pins 42. Again, the return motion of the double bell crank drive is accomplished by springs (not shown) while the axial closing motion of the cheek plates 35, 36 is accomplished by the expanding cone 5 during the piston power stroke entering between the still closed bell crank pairs 38, 39 and bringing the bell cranks to their stretch position. During this action, the slide 37 with the cheek plates is pressed forward.

The drive principle explained by FIG. 5 is incorporated in the crimping tool of FIGS. 3 and 4. It shows the springs 43 which return the bell crank drive to its initial position after each power stroke.

Figure 2:
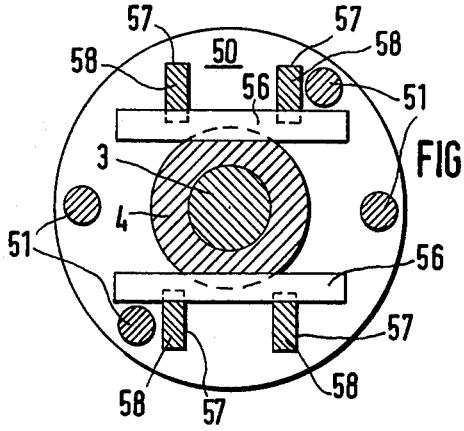
FIG. 2 shows a section taken along line II—II of FIG. 1.

The initially mentioned structure of the tool is formed by four lengthwise running draw rods 58 which in the arrangement shown in FIG. 2 are inserted by their rear ends through slots 57 of two annular disks 50. The two disks 50 are mounted apart on a shoulder formed on the rear side of the piston rod guide bearing 4 and are connected by spacers 51 in between. These two annular disks 50 form, generally speaking, a cage which on the inside is mounted on the guide bearing 4 and which on its outside has the cylinder jacket 1 that is held at the forward rim by a snap ring 52. An end ring 53 connects the cylinder jacket 1 with the housing jacket 12. Inside the open space of the cage formed by annular disks 50, the outside of the guide bearing 4 has grooves or milling cuts 54 and mating cuts 55 on the inside of the draw rods 58. By means of the two keys 56 driven between the two annular disks 50, the cage is keyed to the draw rods 58. The connection can be broken at any time by driving out the keys 56. It is expedient that the keys 56 be secured by a screw, a pin, etc.

Depending on the design of the tool, the draw rods 58 may be bent inward by a certain amount in the embodiment of FIG. 1, or straight draw rods 58′ are used according to FIGS. 3 and 4. In both cases, the draw rods at their forward ends have drill holes or mountings 60 for interchangeable insertion of the tool head which is then held in position by safety bolts 61.

Through the direct connection of the piston guide bearing 4 via draw rods 58 or 58′ with the tool head, all stressed occurring in the tool are absorbed by the draw rods 58.

It is particularly significant that the draw rods and the annular disks forming the cage and all other elements, including the elements forming the individual lever drives, are designed as punched or pressed parts, making manufacture and assembly cheaper and simpler.

Finally, underneath the actuating lever 11 on the cylinder 1, is a rotating ring 62 which has a projecting head 63 and is used to secure the actuating lever 11 in its non-operating position. To this end, only ring 62 must be turned in such a way that the head 63 is underneath lever 11.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

I claim:

1. A crimping tool comprising, in combination: cheek plates; an axially reciprocating piston; a lever drive; said cheek plates being closed and opened by said axially reciprocating piston via said lever drive; securing means linked to said piston drive and operating as a function of the piston motion, said securing means permitting interruption of the piston drive only after complete closure of said cheek plates; said securing means comprises guide means on an actuating lever for turning on and off said cheek plate drive and extending in the direction of piston movement; an abutment slidable along said guide means and located on said piston; said guide means having on one end a point of engagement and having on the other end a point of disconnection at a distance corresponding to the full piston stroke, so that during actuation of said actuating lever said guide means and abutment are engaged for holding said actuating lever in the turned-on position for the duration of a full piston stroke.

2. The crimping tool as defined in claim 1 including pressure medium drive means; valve means with an actuating lever for controlling said pressure medium drive means, said securing means operating jointly with said actuating lever and said valve means so that pressurized supply from said pressure medium drive means for said piston is interrupted only after complete closure of said cheek plates.

3. The crimping tool as defined in claim 1 including means holding on one end a compressed-air cylinder with said piston and lever drive means for actuating said cheek plates, said lever drive means comprising a double bell crank drive, said holding means having on another end a mounting socket for mounting an interchangeable tool head.

4. The crimping tool as defined in claim 1 wherein said guide means on said actuating lever has a longitudinal slot and has expansion portions on its ends for forming the engagement and disconnection points; and a pin on said piston with an enlarged head and passing through said expansion portions for forming said abutment.

5. The crimping tool as defined in claim 4 wherein said guide means has chamfered sections at the start and end sides of said guide means for said abutment on said piston, said abutment having corresponding raceways.

6. The crimping tool as defined in claim 4 including spring means for actuating said actuating lever to the off position of said lever.

7. The crimping tool as defined in claim 4 including spring means for returning said lever drive or piston to an initial position.

8. The crimping tool as defined in claim 1 including auxiliary actuating lever means extending to the tool head from the rear end of the tool and being offset in the substantially central portion, said auxiliary actuating lever means passing through said housing jacket and having a portion on the inside of said housing jacket forming said guide means operating jointly with said abutment, the portion of said auxiliary actuating lever means on the outside of said housing jacket forming said first-mentioned actuating lever for turning on and off.

9. The crimping tool as defined in claim 8 including an adjusting ring with projecting heads underneath said first-mentioned actuating lever, said adjusting ring with projecting heads forming an interlock against accidental turn-on when rotated underneath said actuating lever.

10. A crimping tool comprising, in combination: cheek plates; an axially reciprocating piston; a lever drive; said cheek plates being closed and opened by said axially reciprocating piston via said lever drive; securing means linked to said piston drive and operating as a function of the piston motion, said securing means permitting interruption of the piston drive only after complete closure of said cheek plates; means holding on one end a compressed-air cylinder with said piston and lever drive means for actuating said cheek plates, said lever drive means comprising a double bell crank drive, said holding means having on another end a mounting socket for mounting an interchangeable tool head; said holding means comprises draw rods running in lengthwise direction of the tool; and guide bearing means, said draw rods extending forward and being fastened to said guide bearing means for the rod of said piston.

11. The crimping tool as defined in claim 10 including an annular cage placed on said guide bearing means and secured in place by key means, said draw rods being inserted at the rear end into said annular cage, the cylinder of said piston being slidable onto said cage; and a snap ring for holding said cylinder and absorbing tensile and compressive forces.

12. The crimping tool as defined in claim 11 wherein said cage is comprised of two punched annular disks connected by spacer bolts.

13. The crimping tool as defined in claim 10 wherein said draw rods and said guide bearing means have mating keyways for receiving keys on facing sides.

14. The crimping tool as defined in claim 10 including a holder for securely holding said draw rods at their forward end and connecting said draw rods, said draw rods having drill holes for attaching to an interchangeable tool head.

15. The crimping tool as defined in claim 10 including an expanding cone mounted on the rod of said piston; lever drive means for actuating said cheek plates; said holding means comprising four draw rods with a free space therebetween for axial motion of said expanding cone.

16. The crimping tool as defined in claim 15 wherein said lever drive means is located on the tool head or between said draw rods for forming a double bell crank drive linkage.

17. The crimping tool as defined in claim 16 including annular disks forming said cage, said draw rods, annular disks and parts of said lever drive means being comprised of punched elements.

18. A crimping tool comprising, in combination: cheek plates; an axially reciprocating piston; a lever drive; said cheek plates being closed and opened by said axially reciprocating piston via said lever drive; securing means linked to said piston drive and operating as a function of the piston motion, said securing means permitting interruption of the piston drive only after complete closure of said cheek plates; means holding on one end a compressed-air cylinder with said piston and lever drive means for actuating said cheek plates, said lever drive means comprising a double bell crank drive, said holding means having on another end a mounting socket for mounting an interchangeable tool head; a housing jacket for enclosing said holding means, said jacket being substantially similar in construction to the cylinder of said piston, said jacket together with said cylinder forming the handle of said tool, said actuating lever being located on the outside and extending in a direction of piston movement.

* * * * *